United States Patent [19]

Duncan

[11] 3,983,343

[45] Sept. 28, 1976

[54] LIMIT SWITCH OPERATING SHAFT RETURN SPRING DAMPING DEVICE

[75] Inventor: Eugene F. Duncan, Milwaukee, Wis.

[73] Assignee: Cutler-Hammer, Inc., Milwaukee, Wis.

[22] Filed: June 25, 1975

[21] Appl. No.: 590,210

[52] U.S. Cl. ..... 200/47; 200/153 K; 74/107

[51] Int. Cl.[2] ..... H01H 3/16

[58] Field of Search ..... 200/47, 153 K, 153 P, 200/153 T, 6 A; 74/29, 30, 107

[56] References Cited

UNITED STATES PATENTS 3,649,785 3/1972 Dietrich ..... 200/153 K 3,793,492 2/1974 Duncan et al. ..... 200/47

*Primary Examiner*—Herman J. Hohauser

*Attorney, Agent, or Firm*—Hugh R. Rather; William A. Autio; Michael E. Taken

[57] ABSTRACT

An improved limit switch operator head assembly is disclosed. The assembly includes a rotatable operating shaft which is rotatable in reverse switch commutating directions, and a helically coiled torsion spring for effecting return of the operating shaft to a center or non switch commutating position. It further includes a U-shaped member formed of thin spring steel which is held in friction producing abutting relation against the coils of the torsion spring to damp the snap-back action of the latter and thereby prevent reverse rotations of the operating shaft beyond its center position.

5 Claims, 4 Drawing Figures

LIMIT SWITCH OPERATING SHAFT RETURN SPRING DAMPING DEVICE

BACKGROUND OF THE INVENTION

Many industrial limit switches utilize return springs in their operator heads to effect return of the operating shafts and machine element engaging arms to a center or non switch operating positions following disengagement from a moving machine element. Such return springs store energy as a result of rotation of their associated operating shafts. If the operating arms on such shafts are suddenly released by a moving machine element the stored energy in the return springs can, under certain conditions, cause the operating shaft to reversely rotate back to and beyond its center position. Such reverse rotation beyond center position can result in unwanted switch commutations, particularly when the degree of shaft rotation required for switch commutation is small.

The Duncan et al U.S. Pat. No. 3,793,492 discloses an improved Limit Switch Operating mechanism wherein by selectable adjustment of a member within an operating head subassembly switch commutations can be made to occur in either or both directions of operator shaft rotation. Upon release of the arm fixed on the shaft by a moving machine part or the like, a helically coiled torsion spring in the operating head subassembly acts to effect snap-back return of the operator shaft to a center position from either direction or rotation. As commutations of the contacts in that limit switch can be set to occur at as little as 5° of operator shaft rotation, it is desirable to prevent telegraphing oscillations of the operator shaft through and beyond its center position that could occur under the conditions aforementioned.

OBJECTS OF THE INVENTION

It is the primary object of the present invention to provide an improved operating head mechanism for limit switches of the aforementioned type which is characterized by preventing unwanted reverse rotations of the operator shafts beyond their center or non switch operating positions.

A further object is to provide a simple yet effective means for preventing unwanted oscillations of the operator shafts following completion of a desired switch operating rotation and release.

Another object of the invention is to provide means of the aforementioned type which will provide a consistent amount of operator shaft damping action.

Other objects and advantages of the invention will hereinafter appear.

DESCRIPTION OF THE PREFERRED EMBODIMENT

Figure 1:
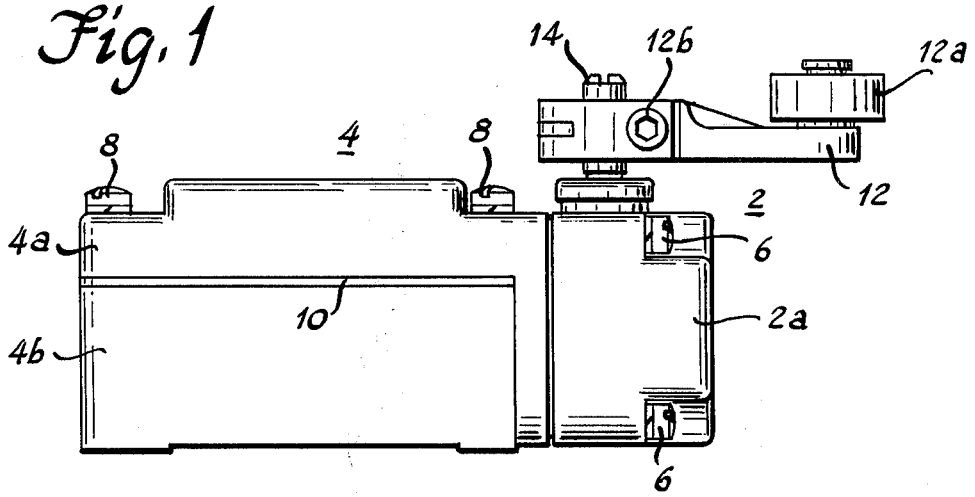
FIG. 1 is a front-elevational view of a limit switch incorporating the invention.

FIG. 1 shows a limit switch which in a preferred form is like that disclosed in U.S. Pat. No. 3,793,492. This limit switch comprises an operating head subassembly 2 and a switch subassembly 4. The operating head 2 is held on the switch subassembly by four screws 6, one at each corner, and may be separated therefrom by removal of such screws. The operating head subassembly may be attached to the switch subassembly at any one of four rotary angles of 90° as fully explained in U.S. Pat. No. 3,793,492.

Figure 2:
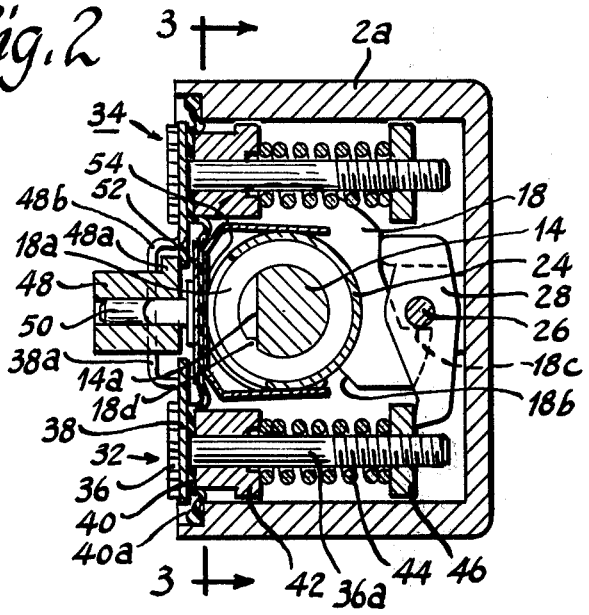
FIG. 2 is an enlarged cross sectional view taken along the line 2—2 of FIG. 1.

Switch subassembly 4 is comprised of two parts; a contact enclosing part 4*a* that extends along the top thereof and then downward at the right adjacent the operating head subassembly 2 as shown in FIG. 2, and an electrical connector enclosing part 4*b* that underlies the part 4*a*. The parts 4*a* and 4*b* are secured to one another by a pair of screws 8 and are sealed by a rubber gasket 10 therebetween. As the parts and mechanism contained in parts 4*a* and 4*b* play no part in the present invention, or in its understanding description of the same is omitted.

The present invention relates particularly to the mechanism contained within the operating head 2. The operating head subassembly is held on the switch subassembly 4*a* by four screws 6, one at each corner, and may be separated therefrom at its mating surface when the screws are removed. The operating head subassembly may be detached in order to set it at any desired 90° angle relative to the mounting surface of the switch subassembly 4*a*.

Figure 3:
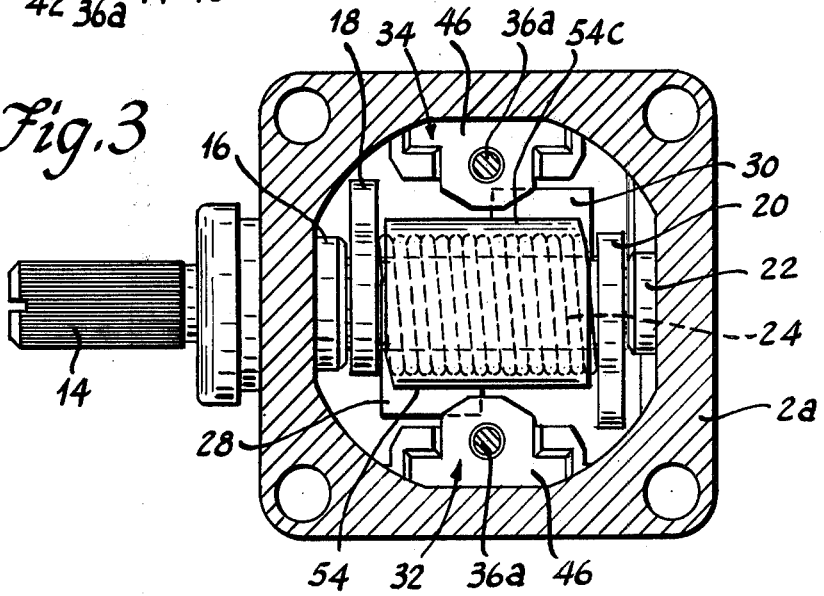
FIG. 3 is a sectional view taken along the line 3—3 of FIG. 2.

Operating head 2 is provided with an operating arm 12 having a roller 12*a* for engagement by a moving machine part or the like. This operating arm may be mounted at any angle on a shaft 14 and secured thereon by tightening a screw 12*b*. The shaft 14, as best shown in FIG. 3, within the housing 2*a* extends through a sleeve bearing 16, a first cam 18, a second cam 20 into a sleeve bearing 22. The cams 18 and 20 are provided with integral bushings extending into abutting relation with one another, bushing 18*a* being shown in FIG. 2.

A wound helical return spring 24 surrounds the bushings 18*a* and 20*a* and has its opposite ends hooked onto their respective cams 18 and 20 to bias shaft 14 to its center "off" position. One end of the spring is hooked into a notch 18*b* shown in FIG. 2 to bias the projection 18*c* of cam 18 against a stop formed by a rocker mounting shaft 26. In a similar manner the spring 24 biases cam 20 against the opposite side of the shaft 26.

Shaft 14 is provided with a flat portion 14*a* against which integral internal nibs on each of the cams, like the nib 18*d*, bear against the upper and lower sides of the flat portion 14*a*. Thus, the force exerted by the return spring 24 on the cams acts to effect return of shaft 14 to its center off position following clockwise or counterclockwise displacement of the shaft and release of operating force from the latter.

Clockwise movement of shaft 14, as viewed in FIG. 2, rotates cam 18 clockwise to pivot a rocker arm 28 clockwise on the shaft 26. Counterclockwise rotation of the shaft 14 rotates cam 20 to pivot a rocker arm 30 on shaft 26. The pivoting of the rocker arms 28 and 30 serve to lift slide members 32 and 34 as will hereinafter be more fully explained.

The slide member assemblies 32 and 34 are identical so only the assembly 32 will be described. As shown in FIGS. 2 and 3, member 32 is provided with a flat head screw 36, whose stem 36*a* extends through a push plate 38, diaphragm seal 40, a bushing 42, a helical compression spring 44 and a nut 46 which is threaded on its end. The spring 44 biases push plate 38 against the head of the screw 36 so that when rocker arm 28 is rocked clockwise to engage nut 46 it moves slide member leftward as viewed in FIG. 2, and moves the plunger 48 leftward on the pin 50.

As shown in FIG. 2, push plate 38 is provided with a lifting tongue 38*a* for lifting plunger 48 by its flange 48*a*, and a pair of offset, spaced apart side tongue 48*b* which laterally constrain the plunger on pin 50. The pin 50 is rigidly secured to a circular metal plate 52 which has the diaphragm seal 40 and an O-ring 40*a* embracing the peripheral edge of the plate attached thereto. The plate 52 has openings therein to accommodate the stems of the screws of the slide member 32 and 34, and the diaphragm 40 is provided with flexible undulations which seal against the stems of such screws to provide for freedom of movement of the latter. The O-ring portion 40*a* compresses between the mating faces of the housing 2*a* and the housing of the switch subassembly 4*a*.

As more fully described in the aforementioned U.S. Pat. No. 3,793,492, the leftward movement of the plunger 48 results in operation of electric switch contact mechanism in subassembly 4*a* to closed circuit condition. This can occur depending upon the selective rotary positioning of the plunger 48 on the pin 50 upon either clockwise, or counterclockwise, or both directions of rotation of the operating shaft 14 as described in that patent.

Figure 4:
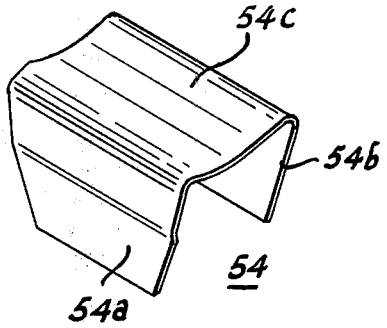
FIG. 4 is a view in perspective of a spring damping element which forms part of the invention.

The operating head assembly of the present invention is provided with an anti-telegraphing or damping member 54 which is best shown in FIG. 4. Member 54 which is preferably formed from relatively thin stainless steel spring stock is provided with depending arms 54*a* and 54*b* which straddle and bear against opposite sides of the torsion spring 24, and an integral connecting bight portion 54*c* that lies between the diaphragm 40 and the spring 24. As shown in FIG. 4 the bight portion 54*c* is slightly concaved in unassembled state, but when clamped between the diaphragm 40, backed by the plate 52, and the spring 24 it flattens and in so doing insures that a controlled amount of friction will occur between the bight portion 54*c* and spring 24.

As shaft 14 is rotated in either direction there is a small degree of radial play of spring 24. As its coil turns expand and contract and the pressure is exerted primarily on the bight portion 54*c* of member 54 provides a consistent retarding friction on spring 24 that prevents it from reversely rotating shaft 14 beyond its center off position after the operating force exerted on the operating arm 12 is relieved. To insure long mechanical life it is preferred that a suitable lubricating grease be applied between the spring 24 and the engaging portions of the member 54.

I claim:

1. In a limit switch operator head, in combination a shaft rotatable in opposite directions;

a pair of spaced apart cams rotatably supported on said shaft and each having a driving connection with said shaft such that they are each rotatable in one direction only which is opposite to that which the other is rotatable by said shaft;

a helically coiled torsion spring concentrically mounted about said shaft and having its opposite ends anchored in respective ones of said cams, said torsion spring acting to return said shaft and said cams to center positions following rotation of said shaft in either direction therefrom, and spring return retarding means comprising a member which applies a constant frictional force on the outer surface of the coils of said spring to damp the recoiling action thereof.

2. The combination according to claim 1 wherein said member is generally U-shaped and has depending arms straddling opposite sides of the coils of said spring and a connecting bight portion that is pressed against said coils to provide said constant frictional force.

3. The combination according to claim 2 wherein said member is formed from relatively thin stainless steel spring stock.

4. The combination according to claim 3 wherein said bight portion of said member is slightly concavedly bowed inwardly of said arms when unassembled and being flattened against said spring coils when assembled as aforestated.

5. The combination according to claim 2 wherein said spring return retarding means includes a plate which applies pressure uniformly on said bight portion of said member in a direction holding the latter against the coil turns of said torsion spring.

* * * * *